US006505826B2

(12) United States Patent
Gerstenberger et al.

(10) Patent No.: US 6,505,826 B2
(45) Date of Patent: Jan. 14, 2003

(54) DEVICE FOR SEPARATING SHEETS PILED UP SO AS TO FORM A STACK, IN A FEEDER OF A SHEET-PROCESSING MACHINE

(75) Inventors: Markus Gerstenberger, Heidelberg (DE); Andreas Henn, Neckargemünd (DE); Wolfgang Luxem, Kiel (DE); Tobias Müller, Hirschberg (DE); Thomas Wolf, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 62 days.

(21) Appl. No.: 09/785,345

(22) Filed: Feb. 16, 2001

(65) Prior Publication Data

US 2001/0022424 A1 Sep. 20, 2001

(30) Foreign Application Priority Data

Feb. 16, 2000 (DE) ..... 100 07 029

(51) Int. Cl.[7] ..... B65H 3/52

(52) U.S. Cl. ..... 271/121; 271/137; 271/241; 271/167; 271/245; 271/264

(58) Field of Search ..... 271/18, 104, 121, 271/124, 137, 241, 167, 145, 264, 245, 246

(56) References Cited

U.S. PATENT DOCUMENTS

| | | | | |
|---|---|---|---|---|
| 3,991,998 A | * | 11/1976 | Banz et al. | 271/124 X |
| 6,273,416 B1 | * | 8/2001 | Watanabe et al. | 271/121 |
| 6,378,858 B1 | * | 4/2002 | Suga | 271/121 X |
| 6,382,621 B1 | * | 5/2002 | Inoue et al. | 271/121 X |
| 6,402,135 B1 | * | 6/2002 | Werner | 271/121 X |

FOREIGN PATENT DOCUMENTS

| | | |
|---|---|---|
| DE | 34 11 886 A1 | 10/1984 |
| DE | 195 09 487 C1 | 6/1996 |

* cited by examiner

*Primary Examiner*—David H. Bollinger
(74) *Attorney, Agent, or Firm*—Laurence A. Greenberg; Werner H. Stemer; Greogory L. Mayback

(57) ABSTRACT

A device for separating or singling sheets, which have been piled up to form a stack, in a feeder of a sheet-processing machine, having a transport element with a guide edge, includes a device for matching the shape of the guide edge to the contour of the topmost sheet at a front side of the stack, as viewed in a sheet transport direction.

18 Claims, 3 Drawing Sheets

DEVICE FOR SEPARATING SHEETS PILED UP SO AS TO FORM A STACK, IN A FEEDER OF A SHEET-PROCESSING MACHINE

BACKGROUND OF THE INVENTION

Field of the Invention

The invention relates to a device for separating or singling sheets piled up so as to form a stack, in a feeder of a sheet-processing-machine, having a transport element with a guiding edge.

Heretofore known devices for separating or singling sheets, which have been piled up so as to form a stack, in a feeder of a sheet-processing machine have a transport element which is constructed as a pivotable flap and functions for transporting one or more sheets, by a pivoting movement, from the stack to a feeder roll of the machine. For this purpose, the respective sheet resting on the top of the stack is pushed along the guiding edge onto a guide face of the transport element which, by subsequent pivoting movement thereof, transports the respective sheet by the leading edge thereof to the feeder roll. Disadvantageously, the contour of the topmost sheet on the front side of the stack, as viewed in the sheet transport direction, is not always flat, so that it is possible for disruption to occur during the transport of the respective sheet from the stack to the feeder roll, for example, because the sheet is in a skewed position. Individual, visual averaging out of the different heights (lower edge region, higher center region) of the stack at the front side by an operator, and corresponding positioning of the stack and, in particular, of the sheet resting on the top thereof, in relation to the guide edge of the transport element does not lead to reliable results with regard to secure and reliable sheet transport from the stack to the feeder roll.

In addition, the published German Patent Document DE 34 11 886 A1 discloses a device having a first and a second detector for establishing the respective height of the front and rear region of a sheet stack or pile.

SUMMARY OF THE INVENTION

It is accordingly an object of the invention to provide a device of the type mentioned at the introduction hereto which, in a reliable, exact and repeatable manner, ensures correct separation or singling of sheets piled up to form a stack, in the feeder, and trouble-free transport of the respective sheets from the stack to a feeding roller of a sheet-processing machine.

With the foregoing and other objects in view, there is provided, in accordance with the invention, a device for separating or singling sheets, which have been piled up to form a stack, in a feeder of a sheet-processing machine, having a transport element with a guide edge, comprising a device for matching the shape of the guide edge to the contour of the topmost sheet at a front side of the stack, as viewed in a sheet transport direction.

In accordance with another feature of the invention, the shape-matching device has a transport element which is at least one of elastically and plastically deformable so as to match the shape of the guide edge to the contour of the topmost sheet.

In accordance with a further feature of the invention, the separating device includes a measuring device for determining the contour of the topmost sheet at the front side of the stack.

In accordance with an added feature of the invention, the separating device includes an adjusting device for matching the contour of the guide edge to the contour of the topmost sheet.

In accordance with an additional feature of the invention, the separating device includes a control unit operatively connected to the measuring device and to an adjusting device for matching the contour of the guide edge to the contour of the topmost sheet.

In accordance with yet another feature of the invention, the transport element is formed as an L profile in cross section and, at an end thereof, has a stop crosspiece which is bringable into engagement with the front side of the stack and, at a top thereof, the stop crosspiece has a guide crosspiece formed with a guide face onto which the topmost to sheet is transportable, the guide edge being located at the outside between the stop crosspiece and the guide crosspiece.

In accordance with yet a further feature of the invention, the transport element is formed rigid in the sheet transport direction and, at the stop crosspiece, is provided with a plurality of mutually spaced teeth for assisting in an elastic deformation of the transport element for matching the contour of the guide edge to the contour of the topmost sheet.

In accordance with yet an added feature of the invention, the separating device includes a fixing device for firmly clamping the teeth separately in order to stabilize the contour-matched guide edge.

In accordance with yet an additional feature of the invention, the fixing device is formed with holding openings wherein the teeth are freely positionable and firmly clampable, by deforming the transport element, so as to match the contour of the guide edge to the contour of the topmost sheet.

In accordance with still another feature of the invention, the adjusting device includes a plurality of actuators arranged spaced apart from one another.

In accordance with still a further feature of the invention, the actuators are formed as plungers having a position which is adjustable on a rotatable cam disc.

In accordance with an alternative feature of the invention, the actuators are formed as spindles operatable by a drive.

In accordance with still an added feature of the invention, the transport element is pivotable, between a stop position and a transfer position, about an axis of rotation extending perpendicularly to the sheet transport direction.

In accordance with still an additional feature of the invention, a matching of the contour of the guide edge to the contour of the topmost sheet by the adjusting device is dependent upon a pivoting-angle position thereof relative to the transport element.

In accordance with another feature of the invention, the guide edge is formed so as to be contour-matched to the topmost sheet in the stop position of the transport element and to be straight in the transfer position of the transport element.

In accordance with a further feature of the invention, the transport element is movable selectively counter to and in a respective contour-matching direction by a restoring spring element, respectively, compressible and expandable by the pivoting of the transport element.

In accordance with an added feature of the invention, in the transfer position of the transport element, the restoring spring element is compressed, the transport element is retracted and the contour matching of the guide edge is canceled, while, in the stop position of the transport element, the restoring spring element is expanded, the transport element is extended and the contour of the guide edge is completely matched to the contour of the topmost sheet.

In accordance with a concomitant feature of the invention, the transport element is formed as a continuous, pivotable flap, and the fixing device is formed as a pivoting shaft for the flap.

In order to achieve the objective of the invention, a separating device is proposed having features distinguished by the fact that the shape of the guide edge can be adapted or matched to the contour of the topmost sheet at a front side of the stack, as viewed in the sheet transport direction. This advantageously prevents the leading edge of the topmost sheet, which is generally not straight, but rather, bent downwardly, in particular in the edge regions thereof, from colliding with the guide edge as it is displaced from the stack onto a guide face of the transport element, and becoming skewed in an uncontrolled manner with respect to the sheet transport direction. By adapting or matching the contour of the guide edge to the leading edge of the topmost sheet, correct transport of the respective sheet from the stack to the feeder roll of a sheet-processing machine by the transport element is therefore reliably assured.

It is advantageous, for adapting or matching the contour of the guide edge, that the transport element be elastically and/or plastically deformable. A deformable guide edge is particularly suitable for exact and repeatable adaptation or matching of the contour to the leading edge of the topmost sheet. In this regard, both an elastic, plastic, as well as also a combined, partially elastic and partially plastic deformation of the guide edge is used to adapt or match the contour.

The separating device advantageously has a measuring device for determining the contour of the topmost sheet at the front side of the stack. By using a measuring device, for example, a sensor which can be displaced over the front side of the stack in the direction of the stack width, or a plurality of sensors arranged spaced apart over the front side of the stack in the direction of the width of the stack, it is possible, in a rapid, exact and possibly also continuous manner, to determine the contour of the respectively topmost sheet at the front side of the stack. Based upon these exact determined data, a precise, possibly automatic, adaptation or matching of the contour of the guide edge to the contour of the respective topmost sheet is assured.

The separating device preferably has an adjusting device for adapting or matching the contour of the guide edge to the contour of the topmost sheet. The use of an adjusting device makes it possible, preferably in an automatic manner, to implement exact and repeatable adaptation or matching of the contour of the guide edge to the contour of the topmost sheet. In addition, an adjusting device permanently operatively connected to the transport element permits continuous adaptation or matching of the contour of the guide edge to the contour of the topmost sheet, even during the operation of the separating device, using measured values which are likewise determined continuously.

According to a preferred embodiment, the separating device has a control unit which is operatively connected to the measuring device and the adjusting device. A control unit of this type permits automatic, user-friendly and reliable adaptation or matching of the contour of the guide edge, even during the operation of the separating device, with regard to the contour established, respectively, by the topmost sheet at the front side of the stack. Thereby, in a particularly effective manner, rapid and simultaneously correct transport of the respectively topmost sheet from the stack to the feeder roll of the sheet-processing machine by the transport element is assured.

The transport element is preferably formed as an L profile in cross section and, at an end thereof, has a stop crosspiece which is bringable into engagement or touching contact with the front side of the stack and, at the top thereof, the transfer element has a guide crosspiece onto a guide face of which the topmost sheet can be transported, the guide edge being located at the outside between the stop crosspiece and the guide crosspiece. A transport element constructed in this manner is particularly suitable for forming, on the one hand, a stop for the leading edges of a plurality of sheets resting on the stack at the top or stop crosspiece and, on the other hand, for being used as a transport element for transporting the respectively topmost sheet from the stack to the feeder roll. This transport element is suitable, in particular, for adapting or matching the contour of the guide edge or of the entire guide face by appropriate elastic and/or plastic deformation.

The transport element is advantageously formed rigid in the sheet transport direction and, at the stop crosspiece, is provided with a plurality of mutually spaced teeth assisting in the elastic deformation of the transport element to adapt or match the contour of the guide edge. The transport element, which is formed rigid in the sheet transport direction, is particularly suitable as a stop for the leading edges of the sheets resting on the top of the stack. A stop crosspiece provided with a plurality of mutually spaced teeth permits an exact and precisely repeatable elastic deformation of the guide edge or of the guide face of the guide crosspiece in order to achieve correct adaptation or matching of the contour.

According to an alternative embodiment, the teeth are firmly clampable separately by a fixing device in order to stabilize the contour-matched guide edge. The teeth of the stop crosspiece, which are firmly clampable relatively easily in a corresponding fixing device, are particularly suitable for fixing the adaptation or matching of the contour produced by elastic deformation of the transport element.

The fixing device is preferably provided with holding openings, wherein the teeth are freely positionable and firmly clampable, by deforming the transport element, in order to adapt or match the contour of the guide edge. Through the intermediary of a fixing device constructed in this manner and provided with holding openings, the adaptation or matching of the contour of the guide edge and of the guide face of the guide crosspiece, respectively, is possible in a user-friendly and precise manner. In this case, the elastic and/or plastic deformation of the transport element can be performed by manual setting or else automatically by a suitable adjusting device.

The adjusting device is advantageously formed as a plurality of actuators arranged spaced apart from one another. With a plurality of mutually spaced actuators operatively connected to the guide crosspiece of the transport element, it is possible for individual segments of the guide crosspiece (edge regions, central region) to be deformed elastically and/or plastically in such a way that exact and possibly also continuously adjustable contour-adaptation or matching of the guide edge and of the guide face, respectively, of the guide crosspiece is attainable.

According to an alternative embodiment, the actuators are formed as plungers having a position which is adjustable on a rotatable cam disc. Actuators constructed in this manner are particularly suitable for automatic and possibly continuous adaptation or matching of the contour of the guide edge by an appropriate adjustment of the position of the plungers operatively connected to the transport element.

According to a further, alternative embodiment, the actuators are constructed as spindles operatable by a drive.

Spindles which are operated by a drive and are operatively connected to the transport element are also suitable, in particular, for automatic and possibly continuous adaptation or matching of the contour of the guide edge.

The transport element is advantageously pivotable, between a stop position and a transfer position, about an axis of rotation which is perpendicular to the sheet transport direction. A transport element that is movable in this manner is particularly suitable as a stop with respect to the leading edges of the sheets resting on the top of the stack and, simultaneously, as a transport element for rapid and correct transport of the respectively topmost sheet from the stack to the feeder roller of the sheet-processing machine.

The adaptation or matching of the contour of the guide edge by the adjusting device advantageously depends upon the pivoting-angle position with respect to the transport element. Because the contour-adapted or matched guide edge is used in particular to ensure reliable and correct displacement of the topmost sheet from the stack onto the transport element (guide face), the adaptation or matching of the contour of the guide edge does not necessarily have to be maintained until the corresponding sheet is transferred to the feeder roller. It may therefore be advantageous to change the contour of the guide edge depending upon the respective pivoting angle of the transport element.

The guide edge is preferably constructed so as to be contour-adapted or matched in the stop position of the transport element and to be straight in the transfer position of the transport element. Because the feeder roll of the sheet-processing machine is normally constructed straight in the direction of the sheet width, it is advantageous that the guide edge is correspondingly configured straight in the transfer position of the transport element, in order to permit correct and disruption-free transfer of the respective sheet to the feeder roll.

The transport element is preferably movable counter to or in the respective contour-adaptation or matching direction by a restoring spring element that is compressed or expanded by the pivoting of the transport element. Arranging one or more restoring spring elements which are operatively connected to the transport element ensures, in a relatively simple and particularly reliable manner, that the adapted or matching contour of the guide edge is canceled in the transfer position of the transport element by a pivoting angle-dependent movement or displacement of the transport element counter to the respective contour-adaptation or matching direction, because the respectively deformed segments of the transport element are reshaped, due to the displacement of the latter counter to the respective contour-adaptation or matching direction, when the adjusting device is not displaced correspondingly, forming a desired, straight contour of the guide edge.

In the transfer position of the transport element, the restoring spring element is advantageously compressed, the transport element is retracted and the contour adaptation or matching of the guide edge is canceled, while, in the stop position of the transport element, the restoring spring element is expanded, the transport element is extended and the contour of the guide edge is completely adapted or matched. A restoring spring element acting in this manner permits reliable and quick separation of the sheets, piled up to form a stack, in the feeder, and appropriate transport of the respectively topmost sheet from the stack to the feeder roll by the transport element.

The transport element is preferably formed as a continuous, pivotable flap, and the fixing device is constructed as a pivoting shaft for the flap. A transport element not formed from individual, separate segments but as a continuous flap can be mounted and adjusted in a relatively simple manner. In this case, a pivoting shaft formed as a fixing device helps to provide a particularly compact construction of the separating device.

Further advantageous refinements of the invention emerge from the description.

Other features which are considered as characteristic for the invention are set forth in the appended claims.

Although the invention is illustrated and described herein as embodied in a device for separating or singling sheets piled up to form a stack, in a feeder of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

Figure 1:
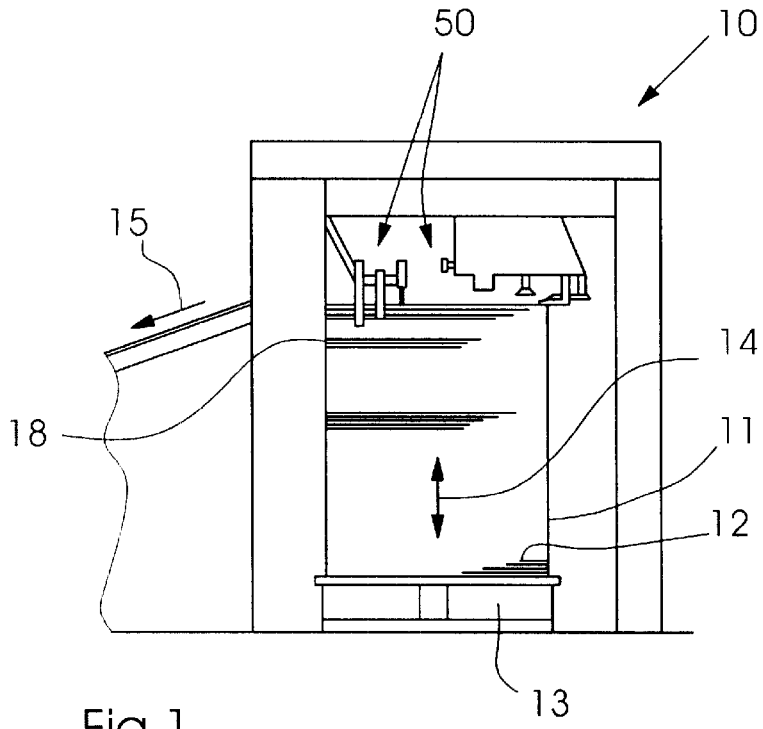
FIG. 1 is a diagrammatic side elevational view of a feeder of a sheet-processing machine.

Referring now to the drawings and, first, particularly to FIG. 1 thereof, there is shown therein a diagrammatic side elevational view of a feeder 10 of an otherwise non-illustrated sheet-processing machine. Arranged in the feeder 10 is a stack or pile pallet 13, whereon sheets 12 are piled up to form a stack or pile 11. The stack pallet or pile 13 is displaceable in a vertical direction, i.e., upwardly and downwardly, together with the pile or stack 11, as indicated by a double-headed arrow 14 in FIG. 1. The feeder 10 has a device, generally identified by the reference numeral 50, for separating or singling the sheets 12 piled up to form the stack or pile 11. The respectively topmost sheet 12 is fed to the sheet-processing machine from the pile or stack 11 by the separating or singling device 50 in a transport direction represented by the arrow 15.

Figure 2:
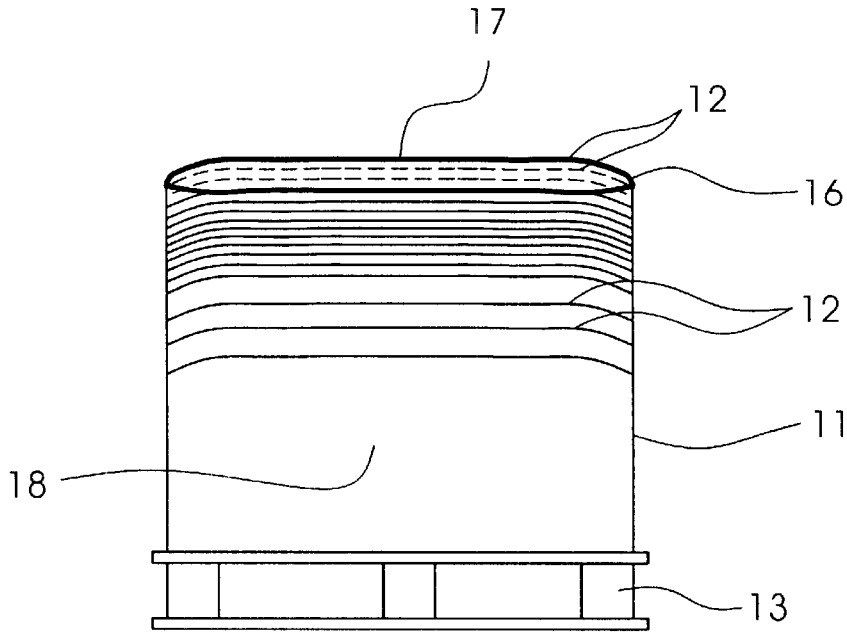
FIG. 2 is a diagrammatic front elevational view of a sheet stack formed of piled-up sheets, and of a transport element arranged at the front side of the stack.

FIG. 2 is a diagrammatic front elevational view of the stack or pile 11 arranged on the stack or pile pallet 13, and a transport element 16 arranged opposite a front side 18 of the stack or pile 11, as viewed in the sheet transport direction 15 (note FIG. 1). The topmost sheet 12 on the stack or pile 11 is not straight, but is curved downwardly in the edge regions thereof, at the front side 18, as viewed in the direction of the sheet width. The transport element 16 is formed with a guide edge 17 having a shape that is adapted to or matches the contour of the topmost sheet 12 at the front side 18 of the stack or pile 11.

Figure 3:
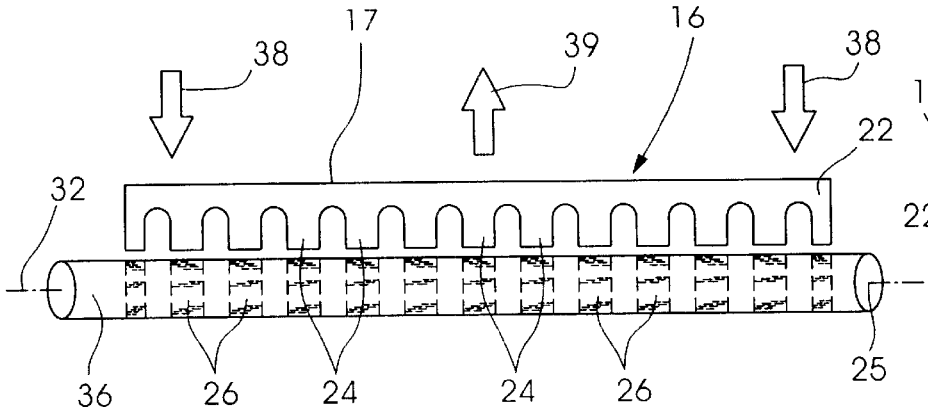
FIG. 3 is a diagrammatic front elevational view of a transport element and a pivoting shaft belonging thereto.
Figure 4:
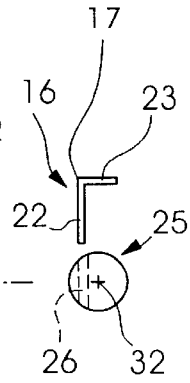
FIG. 4 is a diagrammatic side elevational view of FIG. 3.

FIGS. 3 and 4 show the transport element 16 provided with a cross section preferably formed as an L profile and, at an end, provided with a stop crosspiece 22 and, at the top, provided with a guide crosspiece 23. Between the stop crosspiece 22 and the guide crosspiece 23, the guide edge 17 is located on the outside of the L-shaped transport element 16. The transport element 16 is formed rigid in the sheet transport direction 15, extending perpendicularly into the plane of the drawing of FIG. 3. In order to ensure that the transport element 16 is preferably elastically deformable so as to adapt or match the guide edge 17 to the contour of the topmost sheet 12 at the front side 18 of the stack or pile 11, the stop crosspiece 22 of the transport element 16 is formed with a plurality of mutually spaced teeth 24. In order to stabilize the contour-adapted guide edge 16, the teeth 24 can be firmly clamped separately from one another by a fixing device 25. To this end, the fixing device 25 is provided with take-up or holding openings 26, preferably formed as through-openings, wherein the teeth 24 can be freely positioned and firmly clamped by deforming the transport element 16 in order to match the contour of the guide edge 17. The matching of the contour of the guide edge 17 can be effected by applying to the transport element 16 a deformation force according to the arrows 38, 39, in order, with reference to the contour of the topmost sheet 12 illustrated in FIG. 2 (hanging corners) at the front side 18 of the stack or pile 11, to obtain a contour which is curved downwardly in the end regions of the guide edge 17. In this regard, the matching or adaptation of the contour of the guide edge 17 can be achieved by manually adjustable, elastic deformation or else automatically by an adjusting device not illustrated in FIG. 3. Because the transport element 16 is preferably formed as a continuous, pivotable flap, the fixing device 25 is advantageously configured as a pivoting shaft 36 that is rotatable about an axis of rotation 32. According to the embodiment of FIG. 3, it is thus possible for the transport element 16 both to be fixed in the pivoting shaft 36, after producing an elastic matching or adaptation of the contour of the guide edge 17, and to be pivoted into various operating positions by the very same pivoting shaft 36.

Figure 5:
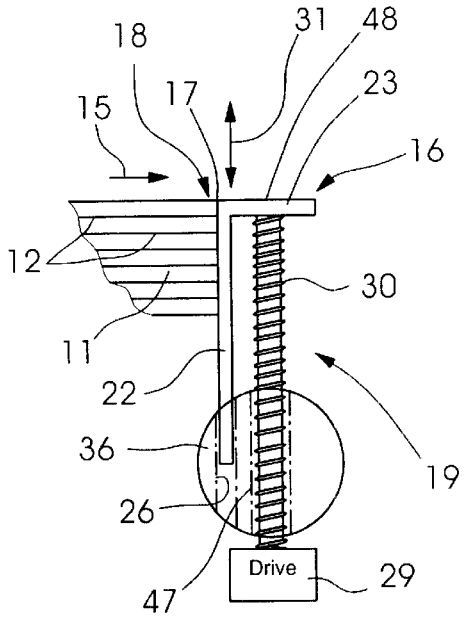
FIG. 5 is an enlarged diagrammatic view of FIG. 4, together with a first embodiment of an adjusting device operatively connected to the transport element.

FIG. 5 illustrates an alternative embodiment of an adjusting device 19 provided for adapting or matching the contour of the guide edge 17 and formed as an actuator. According to this embodiment, the adjusting device 19 is a spindle 30 which is operatable or adjustable by a drive 29 in the vertical direction of the pile or stack according to the double-headed arrow 31. The spindle 30 is operatively connected to the guide crosspiece 23 of the transport element 16 so that, in the event of a movement of the spindle 30 in accordance with the double-headed arrow 31, corresponding elastic and/or plastic deformation of the guide crosspiece 23 and, therefore, also of the guide edge 17, is obtained in order to adapt or match the contour of the latter. The spindle 30 extends through a suitable passage opening 47 formed in the pivoting shaft 36. The holding openings 26 formed as through-openings in the pivoting shaft 36, permit unimpeded movement of the teeth 24 (note also FIG. 3) of the stop crosspiece 22, according to the double-headed arrow 31. The stop crosspiece 22 forms a stop in relation to the leading edges of the sheets 12, piled up to form a stack 11, at the front side 18. The respectively topmost sheet 12 is thereby displaceable in the transport direction represented by the arrow 15 by non-illustrated elements belonging to the separating or singling device 50 onto a guide face 48 containing the guide edge 17, in order to permit the separation of the sheets 12 and onward transport to the sheet-processing machine.

Figure 6:
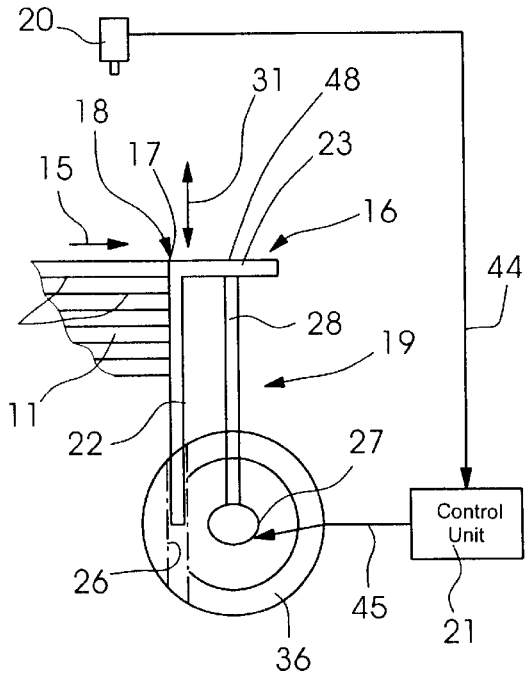
FIG. 6 is a diagrammatic and schematic view like that of FIG. 5 of a second embodiment of the adjusting device operatively connected to the transport element.

FIG. 6 shows a further alternative embodiment of the adjusting device 19, which is constructed as an actuator in the form of a plunger 28, the position of which is adjustable by a rotatable cam disc 27. The plunger 28 according to FIG. 6 functions in the same manner as the spindle 30 according to FIG. 5. As FIG. 6 illustrates, a measuring device 20 in the form of a sensor or detector, for example, is arranged above the front side 18 of the stack 11, in order to determine the respective contour of the topmost sheet 12 in the direction of the sheet width, i.e., in the direction extending perpendicularly into the plane of the drawing of FIG. 6. One possible contour of the topmost sheet 12 in the direction of the sheet width is illustrated in FIG. 2. The determined measured values are transmitted by the measuring device 20, via a transmission line illustrated symbolically as an arrow-headed line 44, to a control unit 21 which, via a control line illustrated symbolically as an arrow-headed line 45, initiates a corresponding adjustment of the plunger 28 in order to achieve suitable contour adaptation or matching of the guide edge 17. Of course, the embodiment according to FIG. 5 can also be provided with such a measuring device or sensor 20 and control unit 21. In both embodiments according to FIGS. 5 and 6, a plurality of adjusting devices 19 spaced apart from one another in the direction of the sheet width are provided, in order to permit exact adaptation or matching of the contour of the guide edge 17 to the determined contour of the topmost sheet 12 at the front side 18 of the stack or pile 11.

Figure 7:
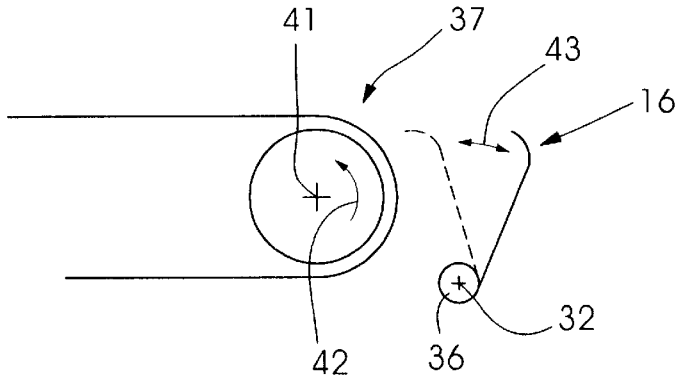
FIG. 7 is a diagrammatic side elevational view of a transport element which is pivotable in the direction of a feeder roll.

As FIG. 7 illustrates, the transport element 16 is pivoted in the direction of a diagrammatically illustrated feeder roll 37 in accordance with the double-headed arrow 43 about the axis of rotation 32 by the pivoting shaft 36 in order to transfer a respective non-illustrated sheet 12 to the feeder roll 37, and pivoted back again to the non-illustrated stack or pile 11 in order to pick up the topmost sheet 12. The feeder roll 37 is rotatable about the axis of rotation 41, according to the arrow 42, in order to transport the respective sheet 12 to the sheet-processing machine. The construction and the functioning of the feeder roll 37 are already known and are therefore neither described nor illustrated in detail herein.

Figure 8:
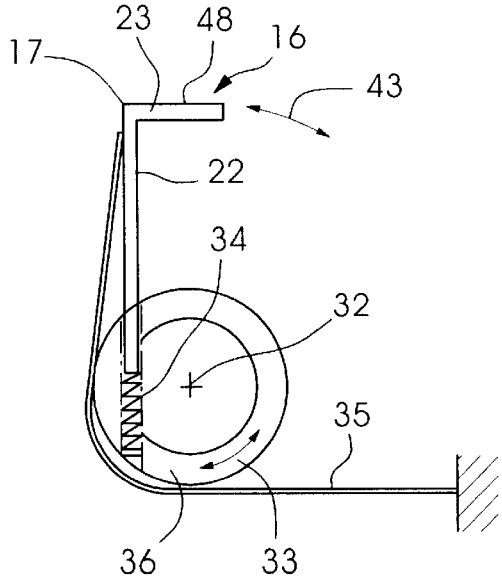
FIG. 8 is a diagrammatic side elevational view of a further embodiment of a transport element disposed in a stop position.
Figure 9:
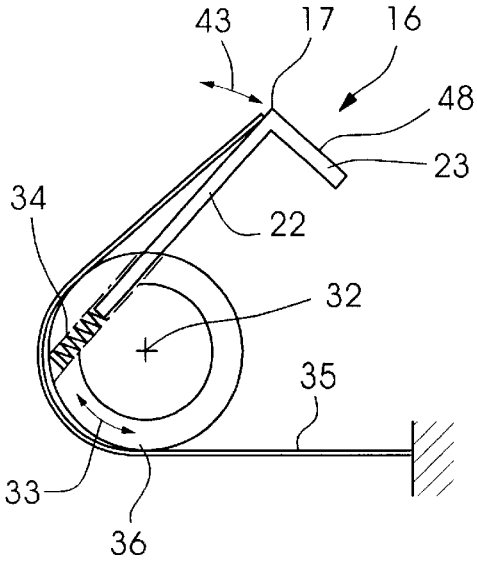
FIG. 9 is another diagrammatic side elevational view of the transport element according to FIG. 8 in a transfer position.

FIGS. 8 and 9 show the transport element 16, which is pivotable in accordance with the double-headed arrow 43, into a stop position (FIG. 8) and into a transfer position (FIG. 9). In this preferred embodiment according to FIGS. 8 and 9, the adaptation or matching of the contour of the guide edge 17 depends upon the pivoting-angle position or setting of the transport element 16. Provided for this purpose is a restoring spring element 34 which, assuming appropriate pivoting of the transport element 16, is compressed or expanded due to a corresponding movement of the transport element 16 counter to and in the respective contour-matching direction, respectively. This movement of the transport element 16 is achieved by a cable pull mechanism 35 which cannot be lengthened but is flexible and firmly connected to the transport element 16 and which, at the other end thereof, is fixed to a stationary holder and, during an appropriate rotational movement according to the double-headed arrow 33 of the pivoting shaft 36 about the axis of rotation 32, effects a retraction of the transport element 16 (note FIG. 9) and, respectively, an extension of the same transport element 16 (note FIG. 8). In the transfer position of the transport element 16 (FIG. 9), the restoring spring element 34 is compressed, the transport element 16 is retracted and the contour adaptation or matching of the guide edge 17 is canceled. In the stop position of the transport element 16 (note FIG. 8), the restoring spring element 34 is expanded, the transport element 16 is extended and the contour of the guide edge 17 is completely matched or adapted. In the transfer position of the transport element 16, the guide edge 17 is therefore formed straight, corresponding to the feeder roll 37, in the direction of the sheet width.

Therefore, in the stop position of FIG. 8, the transport element 16 with the contour-matched or adapted guide edge 17 thereof is particularly suitable for ensuring reliable and disruption-free displacement of the topmost sheet 12 from the stack or pile 11 onto the guide face 48 of the guide crosspiece 23. By pivoting the pivoting shaft 36, which is fixedly connected to the transport element 16 against mutual rotation, about the axis of rotation 32, the transport element 16, together with the non-illustrated sheet 12 at least partially resting on the guide face 48, assumes the transfer position thereof (note FIG. 9), wherein the guide edge 17 is straight and therefore no longer contour-matched, and ensures the reliable and correct transfer of the respective sheet 12 to the feeder roll 37.

In principle, it is possible, before beginning the separation and the transport of the sheets 12, to adapt or match the shape of the guide edge 17 to the contour of the topmost sheet 12 at the front side 18 of the stack or pile 11, and to keep this contour constant during the operation of the separating or singling device 50. However, the preset contour of the guide edge 17 can also be adapted or matched, during the course of the processing of the stack or pile 11, to the changing contour of the respectively-topmost sheet 12 at the front side 18 of the stack or pile 11. There is therefore a continuous adaptation or matching of the contour of the guide edge 17 during the operation of the separating or singling device 50.

We claim:

1. A device for separating or singling sheets, which have been piled up to form a stack, in a feeder of a sheet-processing machine, having a transport element with a guide edge, comprising a device for matching the shape of the guide edge to the contour of the topmost sheet at a front side of the stack, as viewed in a sheet transport direction.

2. The separating device according to claim 1, wherein said shape-matching device has a transport element which is at least one of elastically and plastically deformable so as to match the shape of the guide edge to the contour of the topmost sheet.

3. The separating device according to claim 1, including a measuring device for determining the contour of the topmost sheet at the front side of the stack.

4. The separating device according to claim 1, including an adjusting device for matching the contour of the guide edge to the contour of the topmost sheet.

5. The separating device according to claim 3, including a control unit operatively connected to said measuring device and to an adjusting device for matching the contour of the guide edge to the contour of the topmost sheet.

6. The separating device according to claim 1, wherein said transport element is formed as an L profile in cross section and, at an end thereof, has a stop crosspiece which is bringable into engagement with the front side of the stack and, at a top thereof, said stop crosspiece has a guide crosspiece formed with a guide face onto which the topmost sheet is transportable, the guide edge being located at the outside between said stop crosspiece and said guide crosspiece.

7. The separating device according to claim 6, wherein said transport element is formed rigid in the sheet transport direction and, at said stop crosspiece, is provided with a plurality of mutually spaced teeth for assisting in an elastic deformation of said transport element for matching the contour of the guide edge to the contour of the topmost sheet.

8. The separating device according to claim 7, including a fixing device for firmly clamping said teeth separately in order to stabilize the contour-matched guide edge.

9. The separating device according to claim 8, wherein said fixing device is formed with holding openings wherein said teeth are freely positionable and firmly clampable, by deforming said transport element, so as to match the contour of the guide edge to the contour of the topmost sheet.

10. The separating device according to claim 5, wherein said adjusting device includes a plurality of actuators arranged spaced apart from one another.

11. The separating device according to claim 10, wherein said actuators are formed as plungers having a position which is adjustable on a rotatable cam disc.

12. The separating device according to claim 10, wherein said actuators are formed as spindles operatable by a drive.

13. The separating device according to claim 1, wherein said transport element is pivotable, between a stop position and a transfer position, about an axis of rotation extending perpendicularly to said sheet transport direction.

14. The separating device according to claim 5, wherein a matching of the contour of the guide edge to the contour of the topmost sheet by said adjusting device is dependent upon a pivoting-angle position thereof relative to said transport element.

15. The separating device according to claim 13, wherein the guide edge is formed so as to be contour-matched to the topmost sheet in said stop position of said transport element and to be straight in said transfer position of said transport element.

16. The separating device according to claim 13, wherein said transport element is movable selectively counter to and in a respective contour-matching direction by a restoring spring element, respectively, compressible and expandable by said pivoting of said transport element.

17. The separating device according to claim 16, wherein, in said transfer position of said transport element, said restoring spring element is compressed, said transport element is retracted and the contour matching of the guide edge is canceled, while, in said stop position of said transport element, said restoring spring element is expanded, said transport element is extended and the contour of the guide edge is completely matched to the contour of the topmost sheet.

18. The device according to claim 1, wherein said transport element is formed as a continuous, pivotable flap, and said fixing device is formed as a pivoting shaft for said flap.

* * * * *